US008226216B2

(12) United States Patent
Link et al.

(10) Patent No.: US 8,226,216 B2
(45) Date of Patent: Jul. 24, 2012

(54) METHOD FOR OPERATING CONTINUOUS PRINTERS

(75) Inventors: Robert Link, Webster, NY (US); James L. Bello, Rochester, NY (US); Todd R. Griffin, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 293 days.

(21) Appl. No.: 12/752,576

(22) Filed: Apr. 1, 2010

(65) Prior Publication Data

US 2011/0242170 A1 Oct. 6, 2011

(51) Int. Cl.
*B41J 2/02* (2006.01)

(52) U.S. Cl. ..... 347/73; 347/74; 347/75; 347/80

(58) Field of Classification Search ..... 347/73–83, 347/41

See application file for complete search history.

(56) References Cited

U.S. PATENT DOCUMENTS

| | | | | |
|---|---|---|---|---|
| 1,941,001 | A | 12/1933 | Hansell | |
| 3,373,437 | A | 3/1968 | Sweet et al. | |
| 6,491,362 | B1 | 12/2002 | Jeanmaire | |
| 2002/0113839 | A1 * | 8/2002 | Hawkins et al. | 347/40 |
| 2007/0064065 | A1 * | 3/2007 | Piatt et al. | 347/73 |
| 2010/0259586 | A1 * | 10/2010 | Hawkins et al. | 347/77 |

* cited by examiner

*Primary Examiner* — Julian Huffman
*Assistant Examiner* — Sharon A Polk
(74) *Attorney, Agent, or Firm* — Peyton C. Watkins

(57) ABSTRACT

A method for operating a continuous inkjet printer, the method includes forming drops with a drop formation period being the time between consecutive drop formations; creating a portion of the drops that strike the print media for forming print drops; creating a portion of the created drops that do not strike the print media for forming catch drops; creating the print drops to print on a series of consecutive pixel locations; wherein a time between the creation of consecutive print drops is inconsistent which causes an additional catch drop so that a gap is created; wherein when a gap is created, adjusting a velocity of the print drop adjacent to the gap to cause the print drop to shift slightly toward the gap.

8 Claims, 15 Drawing Sheets

METHOD FOR OPERATING CONTINUOUS PRINTERS

CROSS REFERENCE TO RELATED APPLICATIONS

Reference is made to commonly assigned U.S. patent application Ser. No. 12/752,561 filed Apr. 1, 2010 by Robert Link et al. al., entitled "Continuous Printer With Actuator Activation Waveform", and commonly assigned U.S. patent application Ser. No. 12/752,599 filed Apr. 1, 2010 by Robert Link et al., entitled "Drop Placement Method For Continuous Printers", the disclosures of which are herein incorporated by reference.

FIELD OF THE INVENTION

This invention relates generally to the field of digitally controlled printing devices, such as continuous ink jet printers, having perturbations that break a liquid ink stream into large-volume droplets (print droplets) and small-volume droplets (deflected droplets) and having perturbations during the time period for creating the small-volume droplet that do are not sufficient to cause liquid breakage but are used selectively to calibrate the print droplets to corresponding pixels on the media.

BACKGROUND OF THE INVENTION

Traditionally, digitally controlled color printing capability is accomplished by one of two technologies. Both require independent ink supplies for each of the colors of ink provided. Ink is fed through channels formed in the printhead. Each channel includes a nozzle from which droplets of ink are selectively extruded and deposited upon a medium. Typically, each technology requires separate ink delivery systems for each ink color used in printing. Ordinarily, the three primary subtractive colors, i.e. cyan, yellow and magenta, are used because these colors can produce, in general, up to several million shades or color combinations.

The first technology, commonly referred to as "droplet on demand" ink jet printing, selectively provides ink droplets for impact upon a recording surface using a pressurization actuator (thermal, piezoelectric, etc.). Selective activation of the actuator causes the formation and ejection of a flying ink droplet that crosses the space between the printhead and the print media and strikes the print media. The formation of printed images is achieved by controlling the individual formation of ink droplets, as is required to create the desired image. Typically, a slight negative pressure within each channel keeps the ink from inadvertently escaping through the nozzle, and also forms a slightly concave meniscus at the nozzle helping to keep the nozzle clean.

Conventional droplet on demand ink jet printers utilize a heat actuator or a piezoelectric actuator to produce the ink jet droplet at orifices of a printhead. With heat actuators, a heater, placed at a convenient location, heats the ink to cause a localized quantity of ink to phase change into a gaseous steam bubble that raises the internal ink pressure sufficiently for an ink droplet to be expelled. With piezoelectric actuators, a mechanical force causes an ink droplet to be expelled.

The second technology, commonly referred to as "continuous stream" or simply "continuous" ink jet printing, uses a pressurized ink source that produces a continuous stream of ink droplets. Traditionally, the ink droplets are selectively electrically charged. Deflection electrodes direct those droplets that have been charged along a flight path different from the flight path of the droplets that have not been charged. Either the deflected or the non-deflected droplets can be used to print on receiver media while the other droplets go to an ink capturing mechanism (catcher, interceptor, gutter, etc.) to be recycled or disposed. U.S. Pat. No. 1,941,001, issued to Hansell, on Dec. 26, 1933, and U.S. Pat. No. 3,373,437 issued to Sweet et al., on Mar. 12, 1968, each disclose an array of continuous ink jet nozzles wherein ink droplets to be printed are selectively charged and deflected towards the recording medium.

In another form of continuous ink jet printing, such as is described in U.S. Pat. No. 6,491,362 B1, issued to Jeanmaire, on Dec. 10, 2002, commonly assigned, included herein by reference, stimulation devices are associated with various nozzles of the printhead. These stimulation devices perturb the liquid streams emanating from the associated nozzle or nozzles in response to drop formation waveforms supplied to the stimulation devices by control means. The perturbations initiate the separation of a drop from the liquid stream. Different waveforms can be employed to create drops of a plurality of drop volumes. A controlled sequence of waveforms supplied to the stimulation device yields a sequence of drops, whose drop volumes are controlled by the waveforms used. A drop deflection means applies a force to the drops to cause the drop trajectories to separate based on the size of the drops. Some of the drop trajectories are allowed to strike the print media while others are intercepted by a catcher or gutter.

Having understood some basics of a continuous inkjet printer, a brief description of synchronizing ejected print droplets to the print media is useful. In this regard, one or more printheads are positioned adjacent to a print media such that the printhead is able to deposit ink or other printing fluid on the print media as the print media is moved relative to the printhead. In many such printing systems, the relative velocity of the print media past the printhead (print speed) can vary widely, for example from 50 ft/min. to 1000 ft/min. The velocities are given by way of example and are not limiting to the claimed invention. While the print speed can vary widely, continuous inkjet printers typically have a base drop creation rate or frequency that is fixed, or at least can not be varied widely. In some cases the base drop creation frequency is defined by a printing system clock or by a natural characteristic of the drop generator such as its resonant frequency. As drops can be printed only when drops are created, the time between successive drops that are printed is limited to values that are an integer number of the base drop creation periods. When the print speed is low, the time between successive printed drops corresponds to the base drop creation period times a large integer, while for high print speeds the time between successive print drops corresponds to the base drop creation period times a small integer.

In many types of continuous inkjet, a print drop can not be created at the base drop creation rate. For example in some printing systems that electro-statically deflect the non-print drops so that they strike the catcher, successive print drops must be separated by two or more catch drops. Similarly, by way of example, some print systems that separate print and catch drops by a means of a flow of gas across the drop trajectory, the print drops are formed from the ink that passes through the nozzle during not just one base drop creation period but rather in a plurality, typically three, of the base drop creation periods.

As a result, there are certain print speeds at which the pixel locations on the print media move past the printhead at a rate, called the pixel rate, which exactly matches a frequency at which printable drops can be created. At such speeds the print drop creation rate becomes synchronized with the pixel rate.

At these speeds, the time between successive pixel locations on the pint media passing the printhead is equal to an integer N times the base drop creation period; where N must be 2 or 3 or more, depending on the drop deflection mechanism. For example, if the base-drop creation frequency is 360 kHz, N=3, and the print resolution is 600 drops per inch, this occurs at 200 in/sec print speed. FIG. 4A illustrates this. There are three fundamental drops 100 created at the base-drop creation frequency for each pixel spacing 102 so the drop formation is synchronized with the pixel rate. FIG. 4B illustrates a sequence of drops 104 printed in a print media in one such printer in which the print drops 104 have three times the volume of the non-print drops 100. Since the print drop formation is synchronized with the rate at which pixel moves past the printhead, the print drops are evenly spaced on the print media, landing at a consistent location within the respective pixels locations.

In addition to the 200 in/sec speed at which the pixel rate equaled the base drop creation frequency divided by N=3, other print speeds at which the pixel rate equals the base drop creation rate divided by other larger integer values allow the pixel rate to be synchronized with the print drop creation rate. For the same base drop frequency and print resolution as in the example above and using N=4, a print speed of 150 in/sec is required to match the pixel rate exactly with the print drop creation rate. FIG. 5A illustrates such a case, four fundamental drops 100 are created for each pixel spacing 102. The base drop creation rate is again synchronized with the pixel rate. FIG. 5B illustrates a sequence of print and catch drops where one print drop 104 is created for every four of the base drops 100 and where the print drop has a volume equal to three times the volume of the non-print base drops. A repeated pattern of one print drop 104 and one catch drop 100 are produced for each pixel location 102. Again the print drops are uniformly spaced and land at a consistent place within each pixel interval.

The printing system, however, needs to be able to print not just at those print speeds at which the pixel rate equals the print drop creation rate, but also at all intermediate speeds. For example, it must be able to print not just at 150 in/sec (where N=4) and 200 in/sec (where N=3), but also at print speeds between these two values. At such intermediate print speeds, the time between successive print drops is not fixed. The time between successive print drops is three times the base drop creation period for some of the drops, while other print drop pairs are separated by four times the base drop creation rate. FIG. 6A illustrates a sequence of the base drops 100 created at such a speed. During pixel intervals 1, 3, 4, 6, 7, 9, and 10, three drops 100 were created, while in pixel intervals 2, 5, and 8 four drops were created. When creating print drops to print in each of the pixels, it is necessary to account for this variation in number of base drops that could be created in the pixel time interval. Therefore as shown in FIG. 6B, during pixel intervals 1, 3, 4, 6, 7, 9, and 10, a single print drop 104 was created, while in pixel intervals 2, 5, and 8 one print drop 106 and one catch drop 100 were created. While this ensures that the print drops land within the proper pixel locations, the spacing between print drops is not consistent. This is seen more clearly in FIG. 6C, where the catch drops and the pixel interval markings have been removed to more clearly show how the print drops 106 would look on the print media. Some of the drops are separated from the preceding drop more than the other drops are from the drop that precedes them. These drop spacing intervals where the spacing is different (typically larger) than most of the drop spacing intervals are called synchronization bands or synch incidents 108.

As the print drops are not created at consistent time intervals, their spacing as they drop through the air is also not consistent. As a result the print drops do not encounter the same amount of air drag as they drop from the drop generator to the print media. The print drops 105 preceded by a synch incident 108 encounter more air drag than the other drops. The impact of these drops gets shifted as a result of the increased air drag, to produce a larger apparent synch band as seen in FIG. 6D. Depending on the print conditions, the synch bands may be readily observed by to a person looking at the print. A means to overcome the visibility of synch bands is desired. The present invention addresses this needed improvement.

SUMMARY OF THE INVENTION

A method for operating a continuous inkjet printer, the method comprising forming drops with a drop formation period being the time between consecutive drop formations; creating a portion of the drops that strike the print media for forming print drops; creating a portion of the created drops that do not strike the print media for forming catch drops; creating the print drops to print on a series of consecutive pixel locations; wherein a time between the creation of consecutive print drops is inconsistent which causes an additional catch drop so that a gap is created; wherein when a gap is created, adjusting a velocity of the print drop adjacent to the gap to cause the print drop to shift slightly toward the gap.

DETAILED DESCRIPTION OF THE INVENTION

Figure 1:
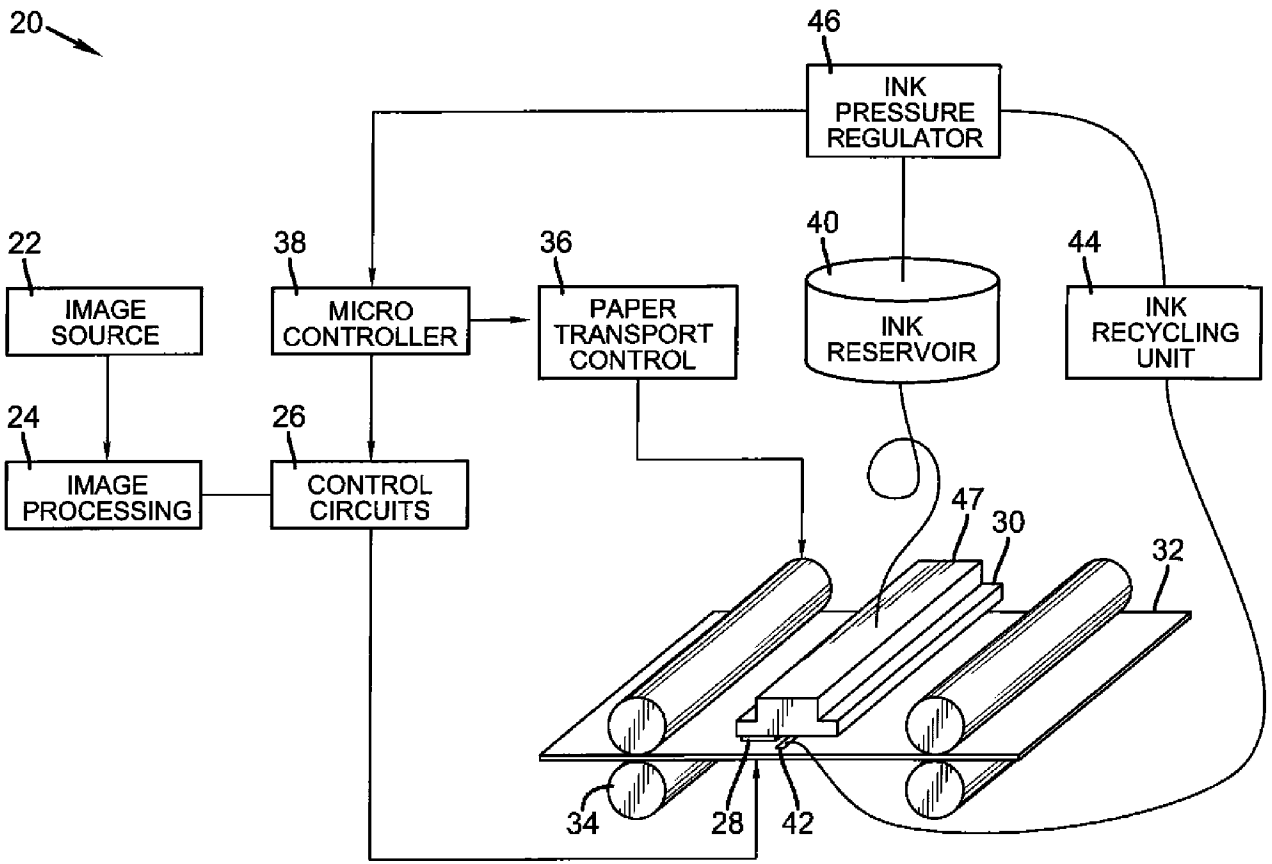
FIG. 1 shows a simplified block schematic diagram of an example embodiment of a printer system made in accordance with the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a printhead or printhead components typically used in inkjet printing systems. However, many other applications are emerging which use inkjet printheads to emit liquids (other than inks) that need to be finely metered and deposited with high spatial precision. As such, as described herein, the terms "liquid" and "ink" refer to any material that can be ejected by the printhead or printhead components described below.

Referring to FIG. 1, a continuous ink jet printer system 20 includes an image source 22 such as a scanner or computer which provides raster image data, outline image data in the form of a page description language, or other forms of digital image data. This image data is converted to half-toned bitmap image data by an image processing unit 24 which also stores the image data in memory. A plurality of drop forming mechanism control circuits 26 read data from the image memory and applies time-varying electrical pulses to a drop forming mechanism(s) 28 that are associated with one or more nozzles of a printhead 30. These pulses are applied at an appropriate time, and to the appropriate nozzle, so that drops formed from a continuous ink jet stream will form spots on a recording medium 32 in the appropriate position designated by the data in the image memory.

Recording medium 32 is moved relative to printhead 30 by a recording medium transport system 34, which is electronically controlled by a recording medium transport control system 36, and which in turn is controlled by a micro-controller 38. The recording medium transport system shown in FIG. 1 is a schematic only, and many different mechanical configurations are possible. For example, a transfer roller could be used as recording medium transport system 34 to facilitate transfer of the ink drops to recording medium 32. Such transfer roller technology is well known in the art. In the case of page width printheads, it is most convenient to move recording medium 32 past a stationary printhead. However, in the case of scanning print systems, it is usually most convenient to move the printhead along one axis (the sub-scanning direction) and the recording medium along an orthogonal axis (the main scanning direction) in a relative raster motion.

Ink is contained in an ink reservoir 40 under pressure. In the non-printing state, continuous ink jet drop streams are unable to reach recording medium 32 due to an ink catcher 42 that blocks the stream and which may allow a portion of the ink to be recycled by an ink recycling unit 44. The ink recycling unit reconditions the ink and feeds it back to reservoir 40. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 40 under the control of ink pressure regulator 46.

The ink is distributed to printhead 30 through an ink channel 47. The ink preferably flows through slots or holes etched through a silicon substrate of printhead 30 to its front surface, where a plurality of nozzles and drop forming mechanisms, for example, heaters, are situated. When printhead 30 is fabricated from silicon, drop forming mechanism control circuits 26 can be integrated with the printhead. Printhead 30 also includes a deflection mechanism (not shown in FIG. 1) which is described in more detail below with reference to FIGS. 2 and 3.

Figure 2:
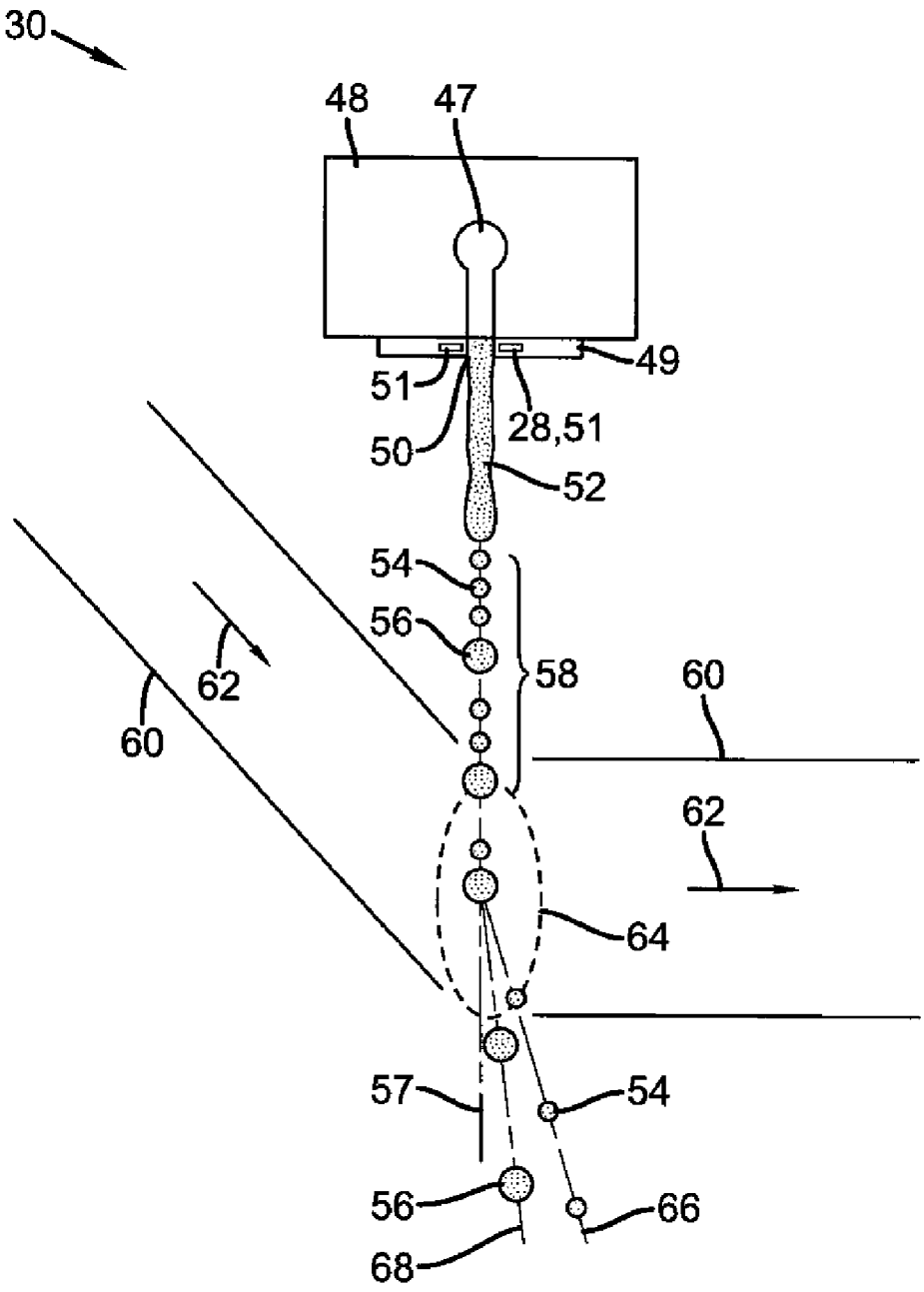
FIG. 2 is a schematic view of an example embodiment of a continuous printhead made in accordance with the present invention.

Referring to FIG. 2, a schematic view of a continuous liquid printhead 30 is shown. A jetting module 48 of printhead 30 includes an array or a plurality of nozzles 50 formed in a nozzle plate 49. In FIG. 2, nozzle plate 49 is affixed to jetting module 48. However, if preferred, nozzle plate 49 can be integrally formed with jetting module 48.

Liquid, for example, ink, is emitted under pressure through each nozzle 50 of the array to form filaments of liquid 52. In FIG. 2, the array or plurality of nozzles extends into and out of the figure and preferably the nozzle array is a linear array of nozzles.

Jetting module 48 is operable to form liquid drops having a first size and liquid drops having a second size through each nozzle. To accomplish this, jetting module 48 includes a drop stimulation or drop forming device or transducer 28, for example, a heater, piezoelectric transducer, EHD transducer, or a MEMS actuator, that, when selectively activated, perturbs each filament of liquid 52, for example, ink, to induce portions of each filament to break off from the filament and coalesce to form drops 54, 56.

In FIG. 2, drop forming device 28 is a heater 51 located in a nozzle plate 49 on one or both sides of nozzle 50. This type of drop formation is known and has been described in, for example, U.S. Pat. No. 6,457,807 B1, issued to Hawkins et al., on Oct. 1, 2002; U.S. Pat. No. 6,491,362 B1, issued to Jeanmaire, on Dec. 10, 2002; U.S. Pat. No. 6,505,921 B2, issued to Chwalek et al., on Jan. 14, 2003; U.S. Pat. No. 6,554,410 B2, issued to Jeanmaire et al., on Apr. 29, 2003; U.S. Pat. No. 6,575,566 B1, issued to Jeanmaire et al., on Jun. 10, 2003; U.S. Pat. No. 6,588,888 B2, issued to Jeanmaire et al., on Jul. 8, 2003; U.S. Pat. No. 6,793,328 B2, issued to Jeanmaire, on Sep. 21, 2004; U.S. Pat. No. 6,827,429 B2, issued to Jeanmaire et al., on Dec. 7, 2004; and U.S. Pat. No. 6,851,796 B2, issued to Jeanmaire et al., on Feb. 8, 2005.

Typically, one drop forming device 28 is associated with each nozzle 50 of the nozzle array. However, a drop forming device 28 can be associated with groups of nozzles 50 or all of nozzles 50 of the nozzle array.

When printhead 30 is in operation, drops 54, 56 are typically created in a plurality of sizes, for example, in the form of large drops 56, a first size, and small drops 54, a second size. The ratio of the mass of the large drops 56 to the mass of the small drops 54 is typically approximately an integer between 2 and 10. A drop stream 58 including drops 54, 56 follows a drop path or trajectory 57.

Printhead 30 also includes a gas flow deflection mechanism 60 that directs a flow of gas 62, for example, air, past a portion of the drop trajectory 57. This portion of the drop trajectory is called the deflection zone 64. As the flow of gas 62 interacts with drops 54, 56 in deflection zone 64 it alters the drop trajectories. As the drop trajectories pass out of the deflection zone 64 they are traveling at an angle, called a deflection angle, relative to the un-deflected drop trajectory 57.

Small drops 54 are more affected by the flow of gas than are large drops 56 so that the small drop trajectory 66 diverges from the large drop trajectory 68. That is, the deflection angle for small drops 54 is larger than for large drops 56. The flow of gas 62 provides sufficient drop deflection and therefore sufficient divergence of the small and large drop trajectories so that catcher 42 (shown in FIG. 3) can be positioned to intercept the small drop trajectory 66 so that drops following this trajectory are collected by catcher 42 while drops following the other trajectory bypass the catcher and impinge a recording medium 32 (shown in FIG. 3).

When catcher 42 is positioned to intercept small drop trajectory 66, large drops 56 are deflected sufficiently to avoid contact with catcher 42 and strike the print media. When catcher 42 is positioned to intercept small drop trajectory 66, large drops 56 are the drops that print, and this is referred to as large drop print mode.

Jetting module 48 includes an array or a plurality of nozzles 50. Liquid, for example, ink, supplied through channel 47, is emitted under pressure through each nozzle 50 of the array to form filaments of liquid 52. In FIG. 2, the array or plurality of nozzles 50 extends into and out of the figure.

Drop stimulation or drop forming device 28 (shown in FIGS. 1 and 2) associated with jetting module 48 is selectively actuated to perturb the filament of liquid 52 to induce portions of the filament to break off from the filament to form drops. In this way, drops are selectively created in the form of large drops and small drops that travel toward a recording medium 32.

Figure 3:
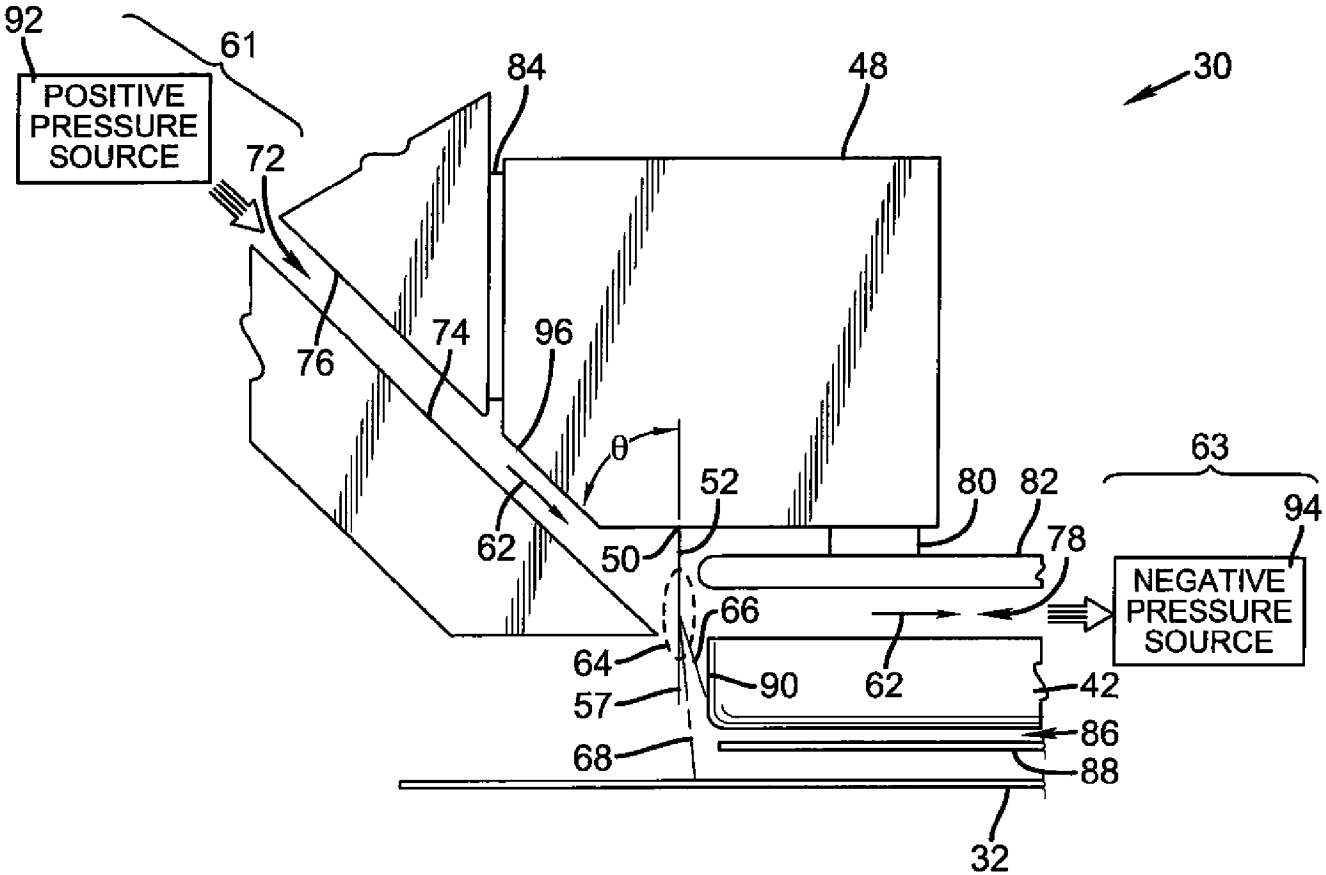
FIG. 3 is a schematic view of a simplified gas flow deflection mechanism of the present invention.
Figure 4A:
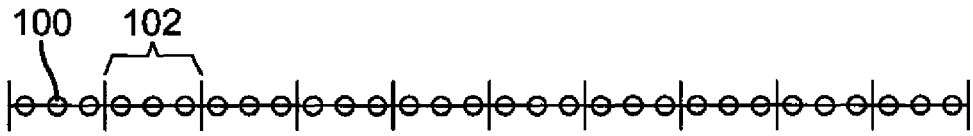
FIG. 4A is a plot of base-drop creation frequency (N=3) per corresponding pixel in which the drop frequency and pixel rate synchronize.
Figure 4B:
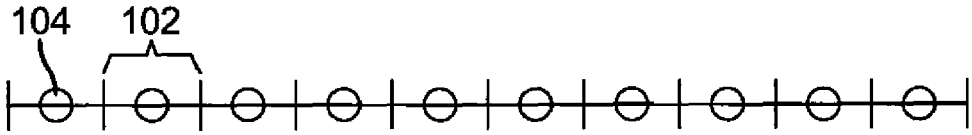
FIG. 4B is a plot of large-volume droplets having three times the base drop frequency per corresponding pixel in which the drop frequency and pixel rate synchronize.
Figure 5A:
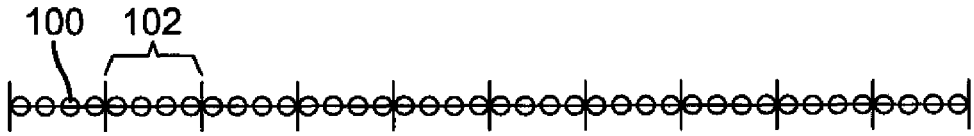
FIG. 5A is a plot of base-drop creation frequency (N=4) per corresponding pixel in which the drop frequency and pixel rate synchronize.
Figure 5B:
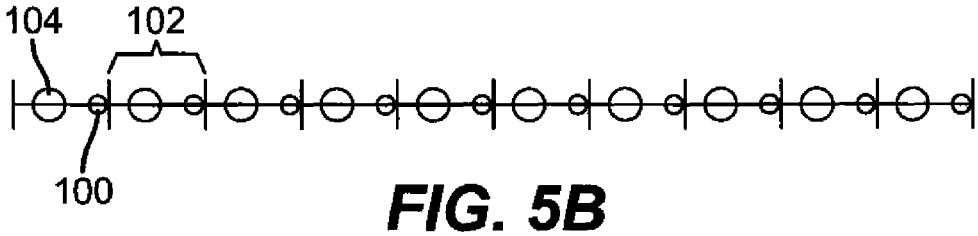
FIG. 5B is a plot of large-volume droplets having three times the base drop frequency and a catch drop per corresponding pixel in which the drop frequency and pixel rate synchronize.

Referring to FIGS. 2 and 3, positive pressure gas flow structure 61 of gas flow deflection mechanism 60 is located on a first side of drop trajectory 57. Positive pressure gas flow structure 61 includes first gas flow duct 72 that includes a lower wall 74 and an upper wall 76. Gas flow duct 72 directs gas flow 62 supplied from a positive pressure source 92 at downward angle θ of approximately a 45° relative to liquid filament 52 toward drop deflection zone 64 (also shown in FIG. 2). An optional seal(s) 80 provides an air seal between jetting module 48 and upper wall 76 of gas flow duct 72.

Upper wall 76 of gas flow duct 72 does not need to extend to drop deflection zone 64 (as shown in FIG. 3). In FIG. 3, upper wall 76 ends at a wall 96 of jetting module 48. Wall 96 of jetting module 48 serves as a portion of upper wall 76 ending at drop deflection zone 64.

Negative pressure gas flow structure 63 of gas flow deflection mechanism 60 is located on a second side of drop trajectory 57. Negative pressure gas flow structure includes a second gas flow duct 78 located between catcher 42 and an upper wall 82 that exhausts gas flow from deflection zone 64. Second duct 78 is connected to a negative pressure source 94 that is used to help remove gas flowing through second duct 78. An optional seal(s) 80 provides an air seal between jetting module 48 and upper wall 82.

As shown in FIG. 3, gas flow deflection mechanism 60 includes positive pressure source 92 and negative pressure source 94. However, depending on the specific application contemplated, gas flow deflection mechanism 60 can include only one of positive pressure source 92 and negative pressure source 94.

Gas supplied by first gas flow duct 72 is directed into the drop deflection zone 64, where it causes large drops 56 to follow large drop trajectory 68 and small drops 54 to follow small drop trajectory 66. As shown in FIG. 3, small drop trajectory 66 is intercepted by a front face 90 of catcher 42. Small drops 54 contact face 90 and flow down face 90 and into a liquid return duct 86 located or formed between catcher 42 and a plate 88. Collected liquid is either recycled and returned to ink reservoir 40 (shown in FIG. 1) for reuse or discarded. Large drops 56 bypass catcher 42 and travel on to recording medium 32. Alternatively, catcher 42 can be positioned to intercept large drop trajectory 68. Large drops 56 contact catcher 42 and flow into a liquid return duct located or formed in catcher 42. Collected liquid is either recycled for reuse or discarded. Small drops 54 bypass catcher 42 and travel on to recording medium 32.

Referring to FIG. 2, alternatively, deflection can be accomplished by applying heat asymmetrically to filament of liquid 52 using an asymmetric heater 51. When used in this capacity, asymmetric heater 51 typically operates as the drop forming mechanism in addition to the deflection mechanism. This type of drop formation and deflection is known having been described in, for example, U.S. Pat. No. 6,079,821, issued to Chwalek et al., on Jun. 27, 2000.

As shown in FIG. 3, catcher 42 is a type of catcher commonly referred to as a "Coanda" catcher. However, the "knife edge" catcher shown in FIG. 1 and the "Coanda" catcher shown in FIG. 3 are interchangeable and work equally well. Alternatively, catcher 42 can be of any suitable design including, but not limited to, a porous face catcher, a delimited edge catcher, or combinations of any of those described above.

Figure 7:
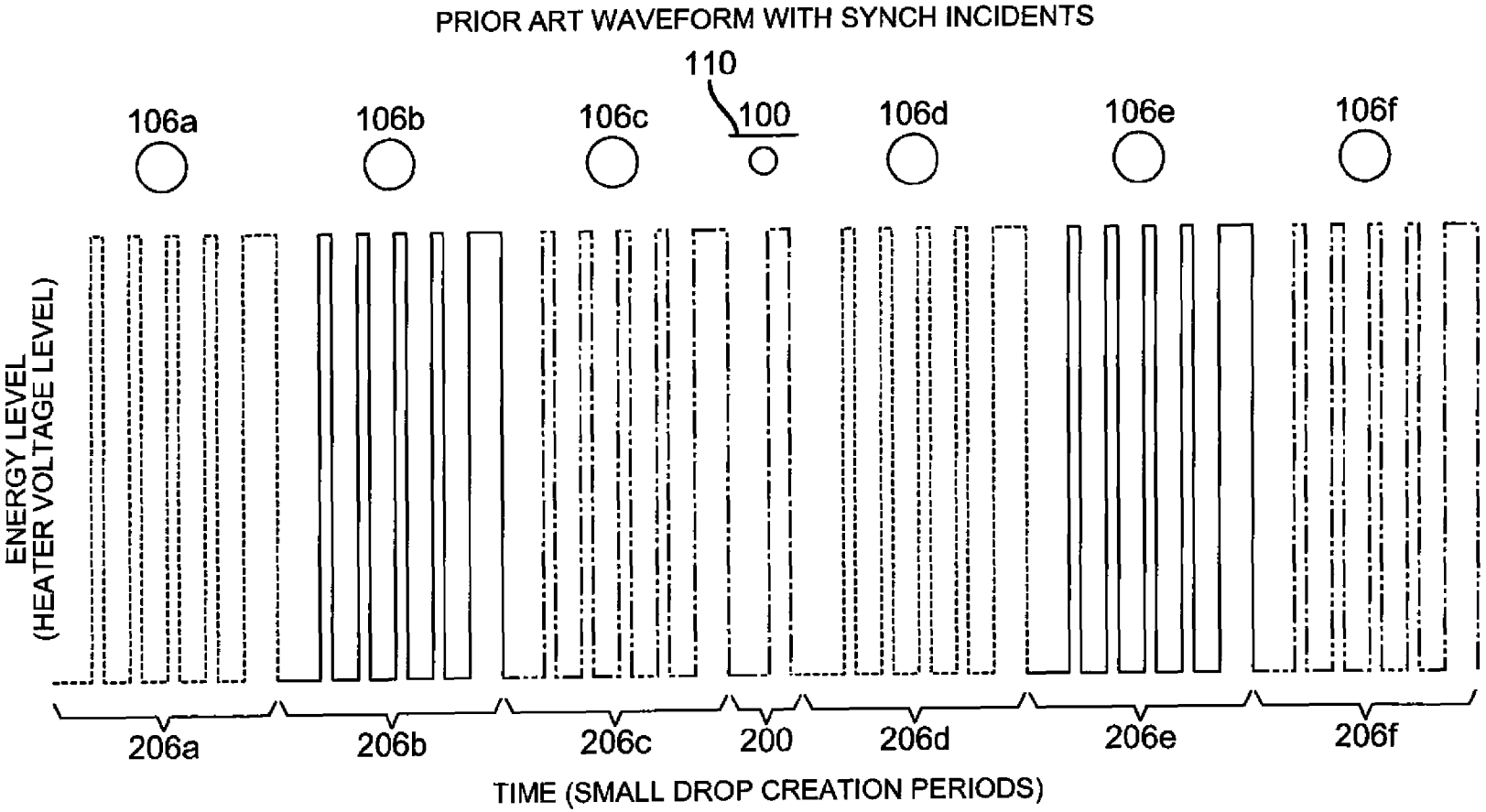
FIG. 7 is a plot showing a prior art sequence of waveforms for the creation of a sequence of drops from a nozzle.

Referring to FIG. 7, there is shown a sequence of waveforms for the creation of a sequence of drops from a nozzle. The sequence includes a small drop waveform 200 for creation of a fundamental drop 100, and a large drop waveforms 206 for the creation of drop 106 having larger volume than the fundamental drop. In this illustration, the waveform 206 has three times the period as the waveform 200, and the drops 106 created by the waveforms 206 have three times the volume of the fundamental drop 100. The waveforms may comprise a single pulse such as waveform 200, or they may comprise a plurality of pulses such as waveform 206 includes. According to the teaching of US Patent Application 2008/0284827, included herein by reference, waveform 200, having a time period equal to the base drop formation period, creates first set of perturbations on the diameter of the liquid stream, having a spatial period x on the liquid stream, which causes the liquid stream to form into small-volume droplets. The final pulse of waveform 206, the waveform having a time period of M times the time period of waveform 200, produces a second set of perturbations on the liquid stream, the second set of perturbations having a spatial period M times x that causes a large-volume droplet to form, in which the large-volume droplet is M times the volume of the small-volume droplets. The earlier pulses in the large drop waveform create produce a third set of perturbations on the diameter of the liquid stream during the large drop waveform period. The spatial period between the perturbations of the third set of perturbations is sufficiently short so that the segment of the liquid stream that forms the large-volume droplet is not broken up thereby.

Figure 6A:
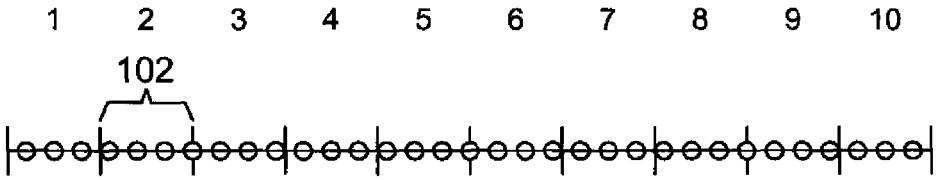
FIG. 6A is plot of drop rate frequency (N=3) per corresponding pixel in which the drop rate and pixel rate are not synchronized.
Figure 6B:
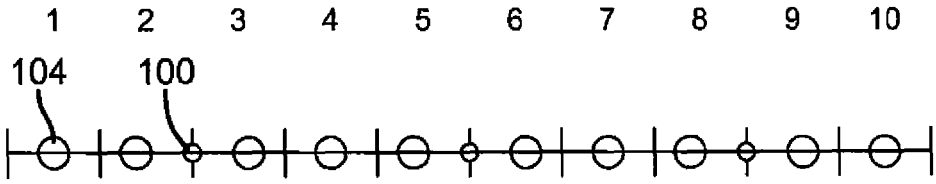
FIG. 6B is a plot of large-volume droplets having three times the base drop frequency and a catch drop per corresponding pixel in which the drop frequency and pixel rate are not synchronized.
Figure 6C:
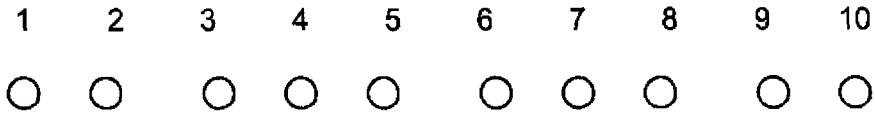
FIG. 6C is a plot of FIG. 6B with the catch drops removed.
Figure 6D:
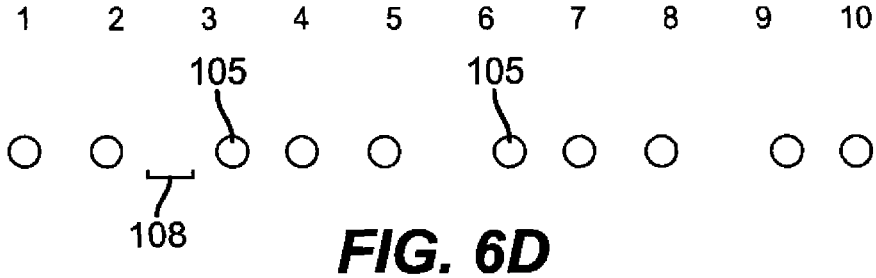
FIG. 6D is a plot of FIG. 6C illustrating the air drag produced by the drop pattern of FIG. 6C.

As explained in the background, printing at speeds at which the drop formation rate is not synchronized with the pixel rate requires periodic synch bands, a non-uniform spacing of print drops to keep the print drops aligned to with the appropriate pixel locations. These synch bands or synch incidents are most noticeable when printing at speeds close the maximum speed of the printer. For the example described in the background, synch bands would be most noticeable at speeds approaching 200 in/sec; 200 in/sec being the print speed at which three fundamental drops are created for each pixel interval. At speeds approaching the 200 in/sec speed, three fundamental drops were created in some of the pixels intervals while four fundamental drops were created for other pixel intervals as illustrated in FIG. 6A. When printing drops in each pixel location, this requires inclusion of a catch drop between the some of the print drops as shown in FIG. 6B. But that leads to the non-uniform spacing of printed drops on the print media illustrated in FIG. 6C or 6D.

The visibility of the synch bands can be reduced significantly, according the present invention, by altering the velocity of the print drops on one or both sides of the catch drop at the synch incident. By slowing down the print drop 106*c* that precedes the catch drop 100 that forms the synch band gap 110, the impact point of the print drop 106*c* can be shifted slightly into the gap 110*a* to reduce the visibility of the gap. In the same way, speeding up the print drop 106*d*, the drop that follows catch drop 100, the impact point of print drop 106*d* can be shifted slightly into the gap 110, reducing the visibility of the synch band.

One method for altering the velocity of a drop is to alter the energy of the activation pulse that created the drop. For example, increasing the duty cycle of the pulse can increase the velocity of the drop, and decreasing the duty cycle of the pulse can decrease the velocity of the drop. While altering the duty cycle is effective at altering the drop velocity, it has been seen to also affect the drop velocity of the both the drop that proceeds and the drop that follows the target drop for the velocity adjustment. Under some conditions, it also can alter the drop formation characteristics, leading to increased satellite drop formation or altering the drop breakoff distance or the time to properly coalesce into a well formed drop.

Figure 8:
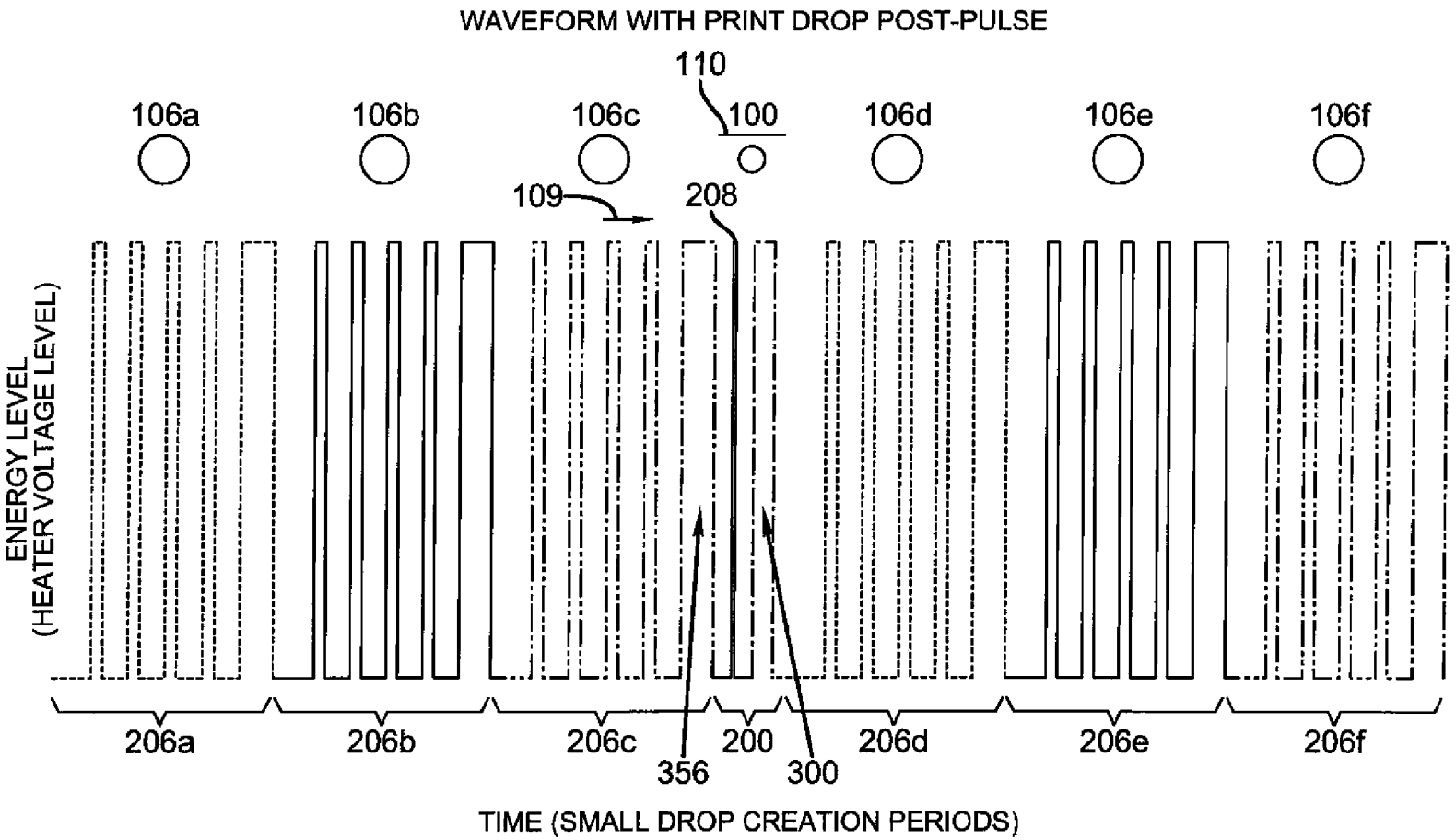
FIG. 8 is a plot showing a sequence of waveforms according to one embodiment of the invention for the creation of a sequence of drops from a nozzle.

An alternate means for altering the velocity of a drop is by inserting a narrow activation pulse either before or after the pulses employed to create the drop. FIG. 8 shows a sequence of waveforms like that shown in FIG. 7, but a velocity modifying pulse 208 is inserted between the last pulse of waveform 206*c* and the pulse of waveform 200. The inserted velocity modifying pulse 208 has the effect of slowing down the drop 106*c* produced by the waveform 206*c* and speeding up the drop 100 produced by the waveform 200. By slowing down print drop 106*c*, its impact position on the print media is shifted as indicated by arrow 109 to partially fill in the synch band 110. The speeding up of drop 100 has no effect on the printed image as drop 100 is deflected to the catcher and does not strike the paper.

Figure 9:
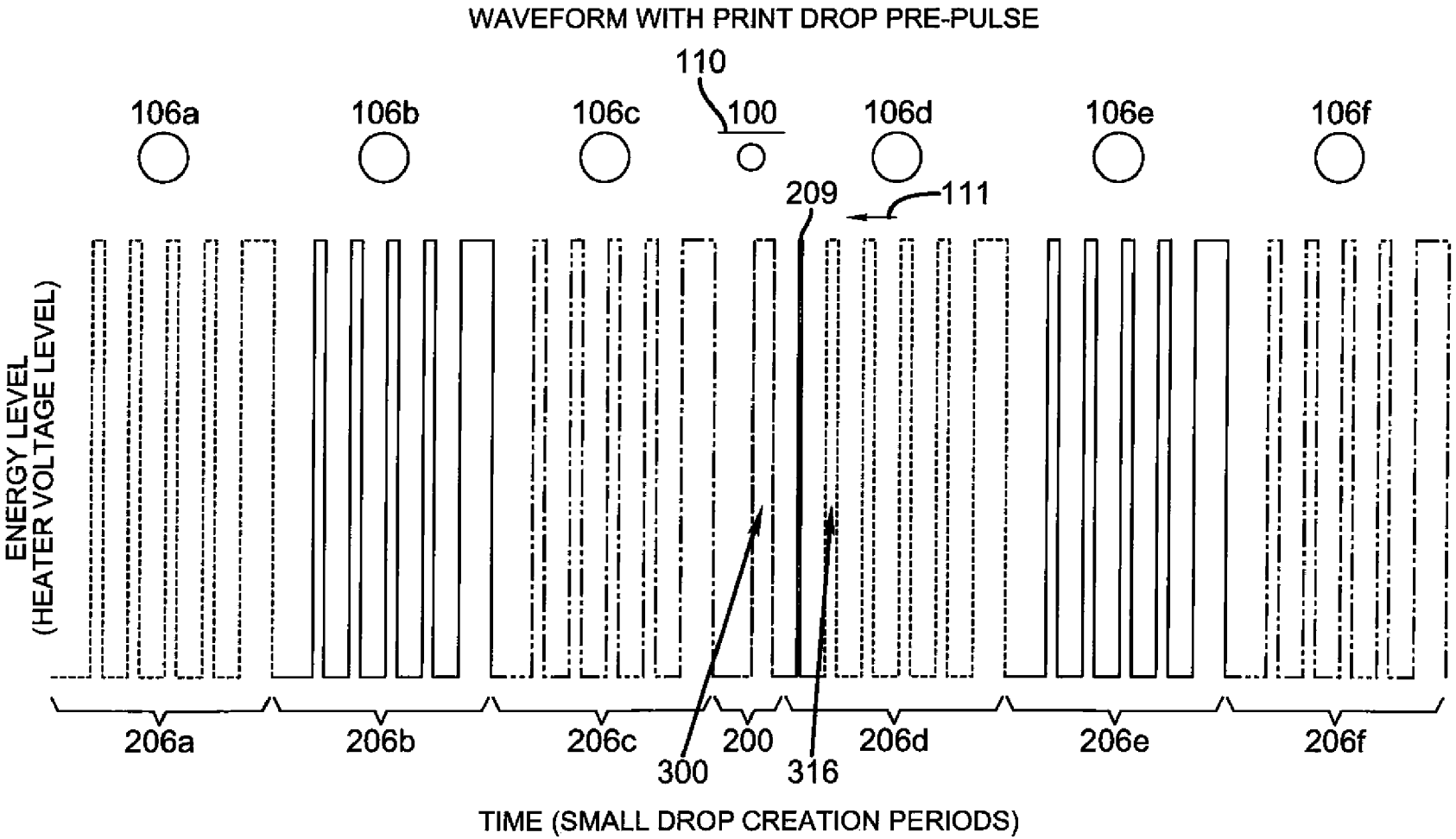
FIG. 9 is a plot showing a sequence of waveforms according to another embodiment of the invention for the creation of a sequence of drops from a nozzle.

FIG. 9 shows a sequence of waveforms in which a velocity modifying pulse 209 is inserted between the pulse of waveform 200 and the first pulse of waveform 206*d*. Inserted pulse 209 has the effect of slowing down drop 100, and speeding up drop 106*d*. The speeding up of drop 106*d* shifts its impact position on the print media, as indicated by arrow 111 to partially fill in gap 110. The slowing down of drop 100 has no effect on print as drop 100 is directed to the catcher. The slight velocity changes of the catch drops by the inserted velocity modifying pulses have no detrimental effect on the ability to catch such drops.

Insertion of the velocity modifying pulse does not produce any shift of the waveforms that follow it. The inserted pulse is not an inserted waveform that delays all the following waveforms, but rather a pulse that is inserted into the time interval between the last pulse of the one waveform and the first pulse of the next waveform. In FIG. 8, the pulse is inserted after the last pulse 356 of waveform 206*c* into the time interval of waveform 200 prior to pulse 300 of waveform 200. In FIG. 9, the velocity modifying pulse 209 is inserted after the pulse 300 of waveform 200 into the time interval of waveform 206*d* that precedes the first pulse 316 of waveform 206*d*. As the time interval into which the velocity modifying pulse is inserted is sufficiently short, the velocity modifying pulse doesn't cause an additional drop to break off from the continuous stream flowing from the nozzle.

Figure 10:
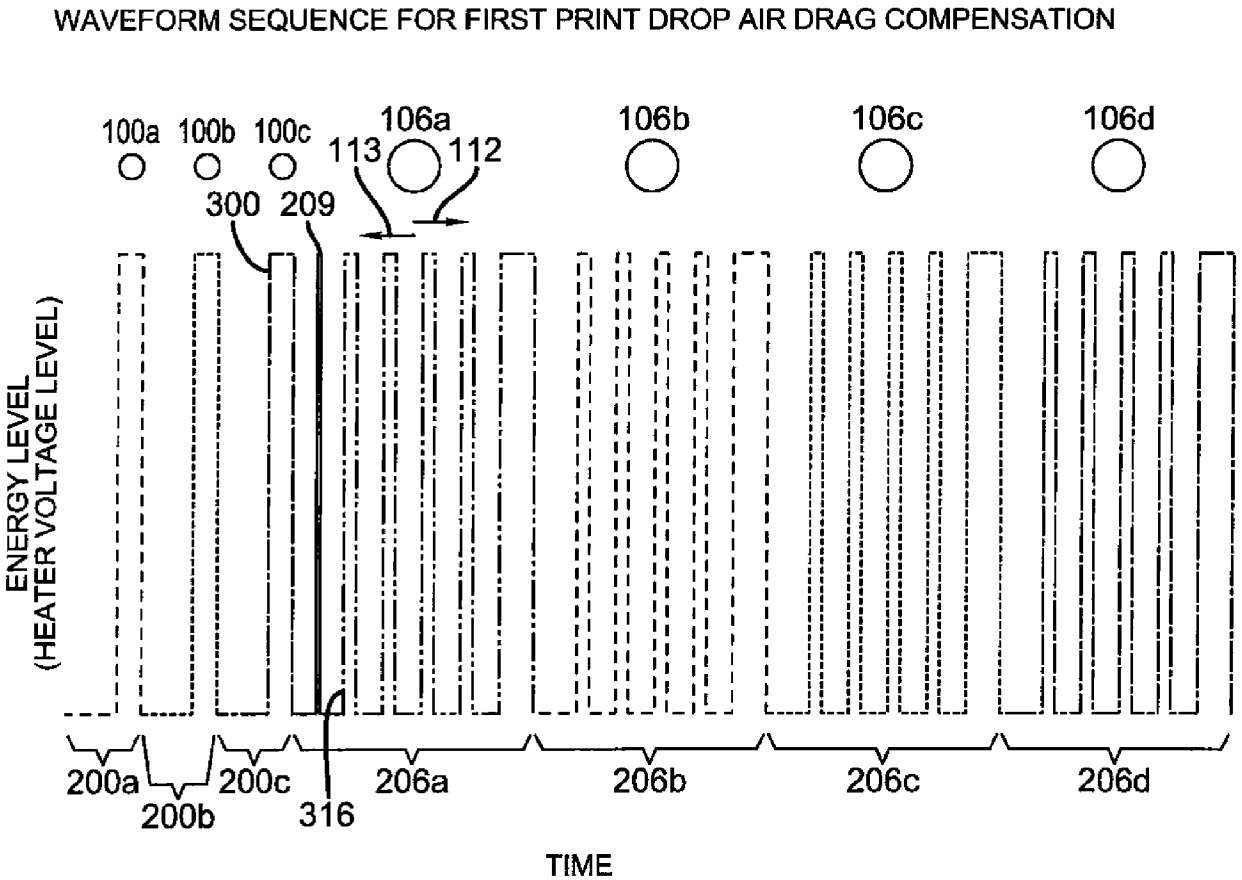
FIG. 10 is a plot showing a sequence of waveform according to an embodiment of the invention to compensate for first print drop air drag.

The velocity modifying pulses have been described relative to their use for reducing the visibility of synch incidents. They may also be employed for other applications in which it is advantageous to modify the drop's velocity relative to the velocity of other drops. For example, when printing the stroke of a character with several consecutive print drops, the first print drop typically encounters more air drag than the following print drops. This can cause the first print drop to impact the print media closer to the second print drop than intended. By inserting a velocity modifying pulse in the time interval just prior to the first pulse of the waveform that creates the first print drop, its velocity can be increased to compensate at least partially for the increased air drag that it encounters. This is illustrated in FIG. 10. Drop 106*a* is the first of several print drops 106*b*-106*d* created after several catch drops 100*a*-100*c*. These catch drops are created by waveforms 200*a*-200*c*, and the print drops are created by waveforms 206*a*-206*d*. The first print drop 206 encounters more air drag than the subsequent print drops, causing the impact location on the print media to be shifted to the right as denoted by arrow 112. To compensate for the increased air drag on drop 106*a* encounters, a velocity modifying pulse 209 is inserted after the pulse of waveform 200*c* and prior to the first pulse 316 of waveform 206*a*. The inserted velocity modifying pulse increases the initial velocity of the first print drop 106*a* relative to that of the other print drops, causing its impact position on the print media to be shifted to the left as denoted by arrow 113, at least partially compensating for the air drag on the first print drop.

Figure 11:
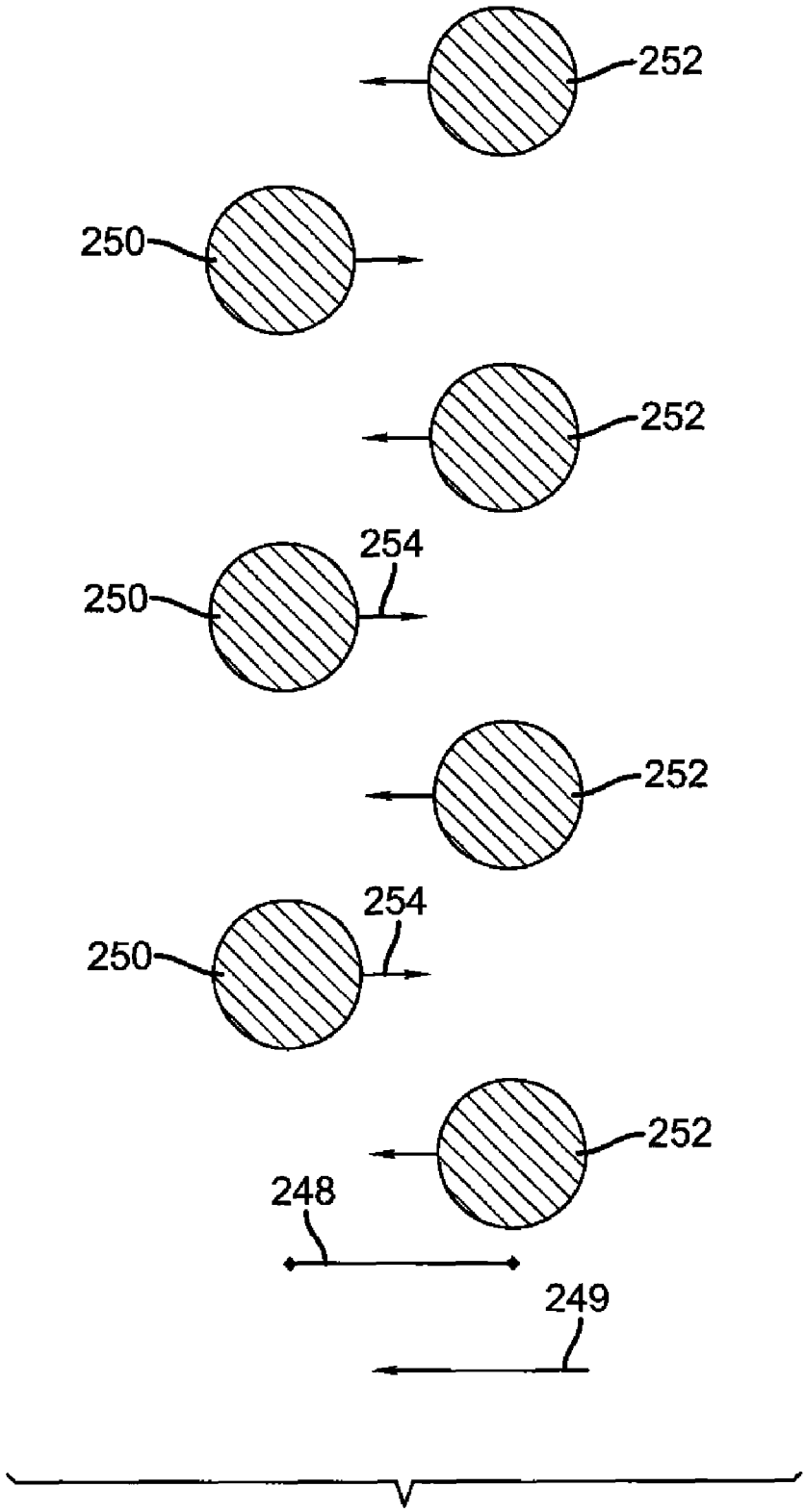
FIG. 11 shows a portion of a single pixel wide line printed with the creation time for the print drops from the odd numbered jets phase shifted relative to the print drops from the even number jets FIGS. 12 *a* and *b* show prior art waveforms for the odd and even numbered jets, respectively, used for printing the single pixel wide line of FIG. 11.

In US Published Application 20080231669, which is herein incorporated by reference, and in application Ser. No. 12/613,683 filed Nov. 6, 2009, which is herein incorporated by reference, it disclosed that print quality can be improved y intentionally phase shifting the creation of print drops from the odd number jets relative to the creation of print drops from the even number jets. While the phase shift is effective in improving the overall print quality, it can introduce a small stagger in the impact positions of the drops from the odd and even numbered jets. This stagger has been found to depend on the spacing between the printhead and the print media and on the drop to drop spacing. Under certain conditions, the stagger of the dots on the print media can be opposite of what one would expect based on which jets have the drop creation phase delayed behind the other. FIG. 11 shows a portion of a single pixel wide line printed on the print media with the print drops from the odd numbered jets phase shifted relative to the print drops from the even number jets. The direction of the print media motion relative to the printhead is indicated by arrow 249. The phase shift produces about a stagger 248 between print location of the dots printed by the even and odd jets, 250, and 252 respectively, with the printed dots from the odd jets 252 appearing to lag behind the drops from the even drops 250. In this context, the even jets while be called leading jets and the odd jets will be called lagging jets, because the dots printed by the even jets appear to lag behind the dots printed by the odd jets. The terms leading and lagging jets are not intended to indicate which set of jets has its drop creation phase delayed relative to the other. As suggested by the arrows 254, the print location stagger can be reduced by adjusting the velocity of the drops from the even jets, the leading jets. Alternatively, the print location stagger can be reduced by adjusting the velocity of the drops from the odd numbered jets, the lagging jets; denoted by arrows 256. In yet another embodiment, the print location stagger can be reduced by both adjusting the velocity of the drops from the leading jets and adjusting the velocity of the drops from the lagging jets, suggested by both arrows 254 and 256.

Figure 12A:
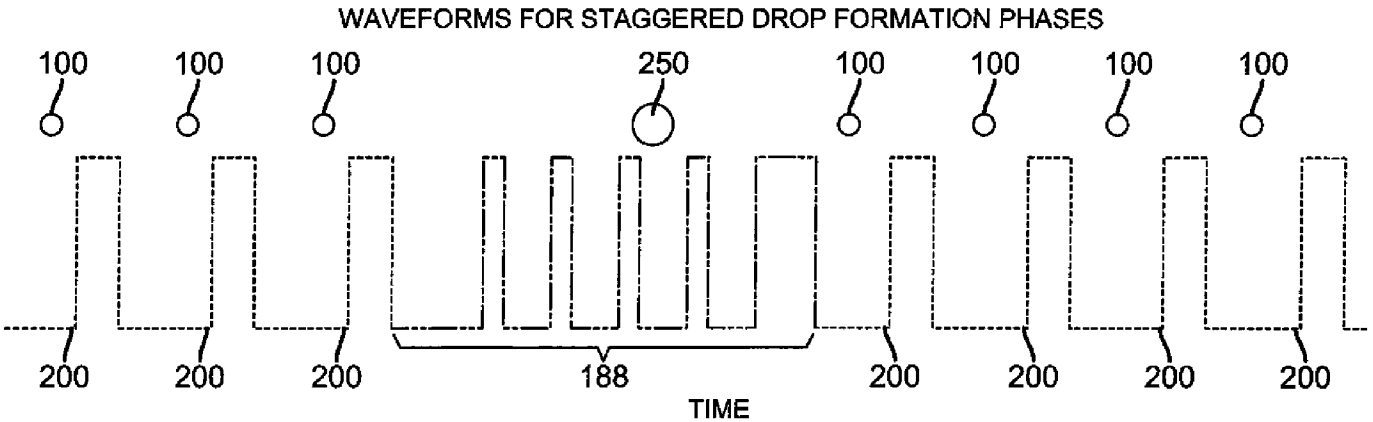
FIG. 12 *c-h* show waveforms for the odd and even numbered jets for printing a single pixel line according various embodiments of the invention.
Figure 12B:
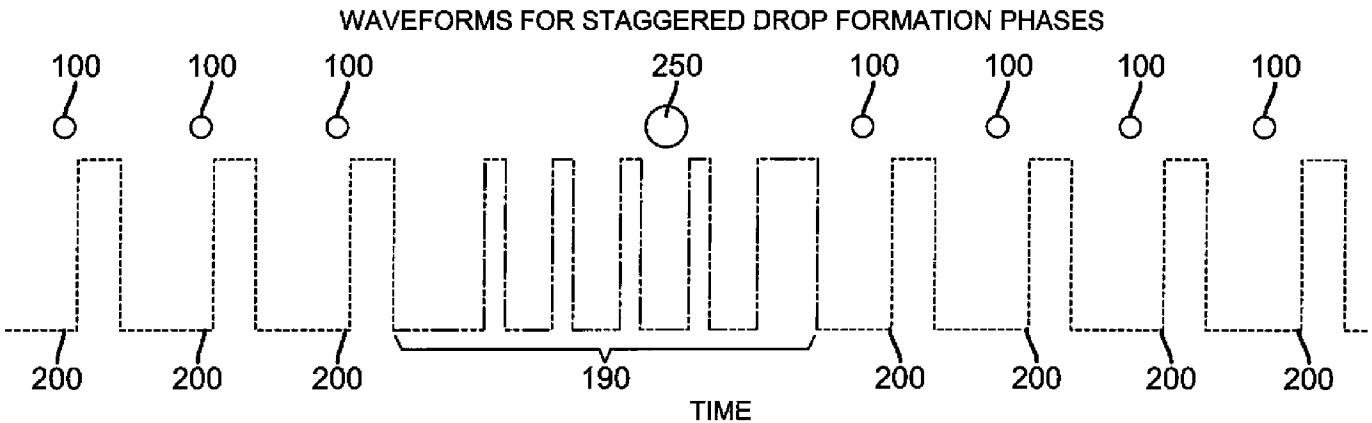

FIGS. 12*a* and *b* show the waveforms and the drops created by the waveforms for creating a single pixel line for the odd numbered jets and the even numbered jets respectively. FIG. 12*a* shows a series of catch drops 100, a print drop 252, and several more catch drops 100 from an odd numbered jet. These drops are created by a series of waveforms 200 for creating catch drops, a waveform 188 for creating the print drop, and several more waveforms 200. FIG. 12*b* shows a similar sequence of catch drops 100 with one print drop 250 created by a sequence of catch drop waveforms 200, print drop waveform 190, and additional catch drop waveforms 200. The waveforms in FIGS. 12*a* and *b* do not include velocity modifying pulses.

Figure 12C:
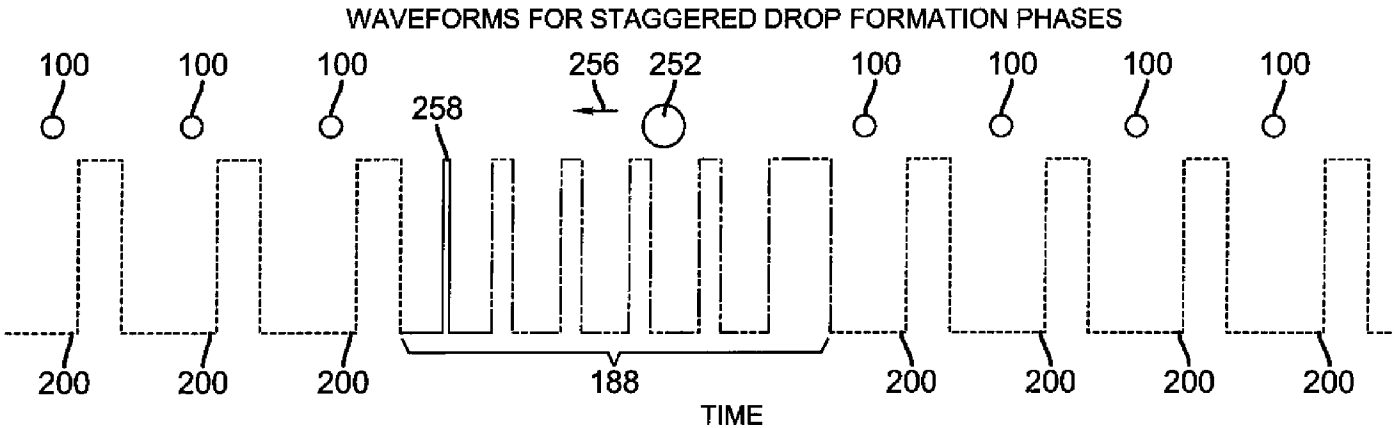
Figure 12D:
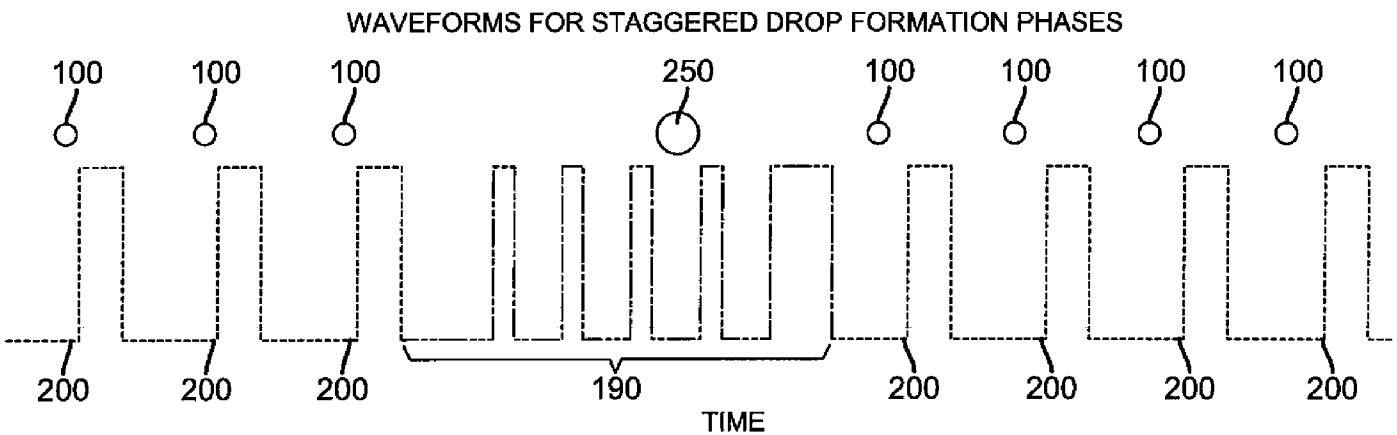
Figure 12E:
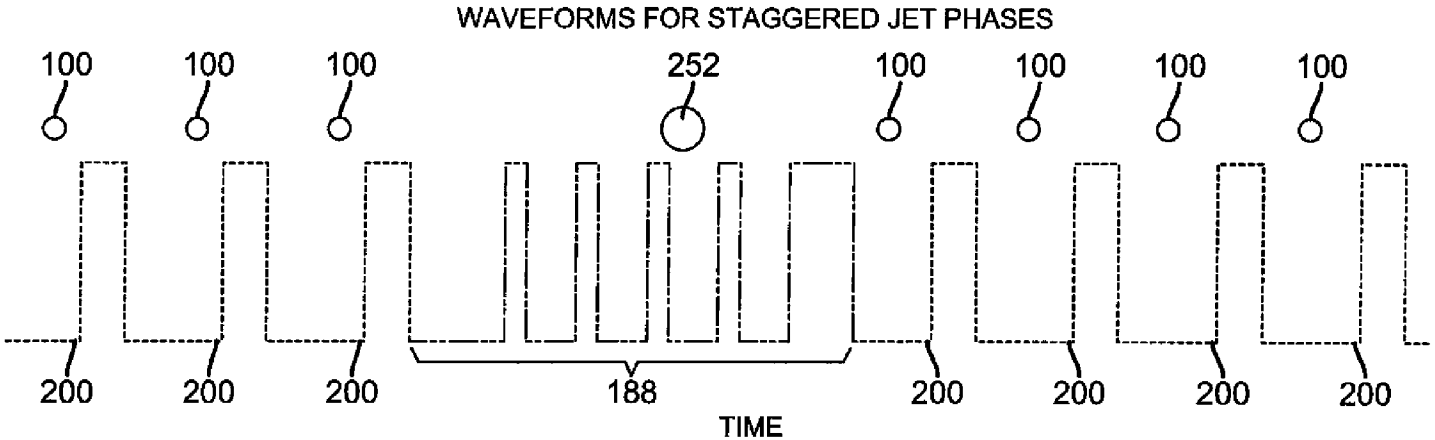
Figure 12F:
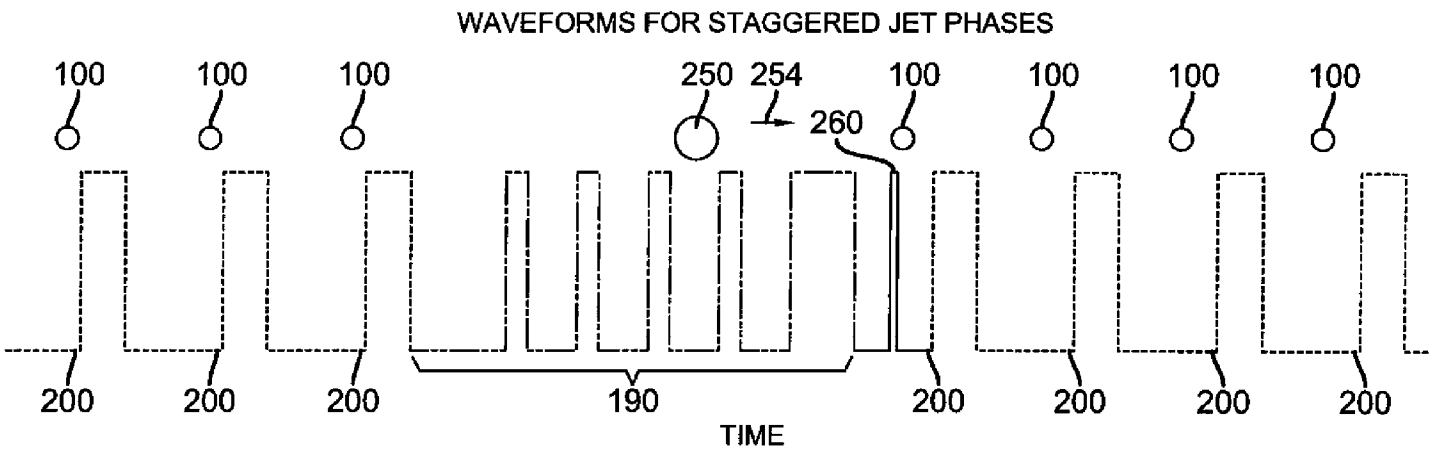
Figure 12G:
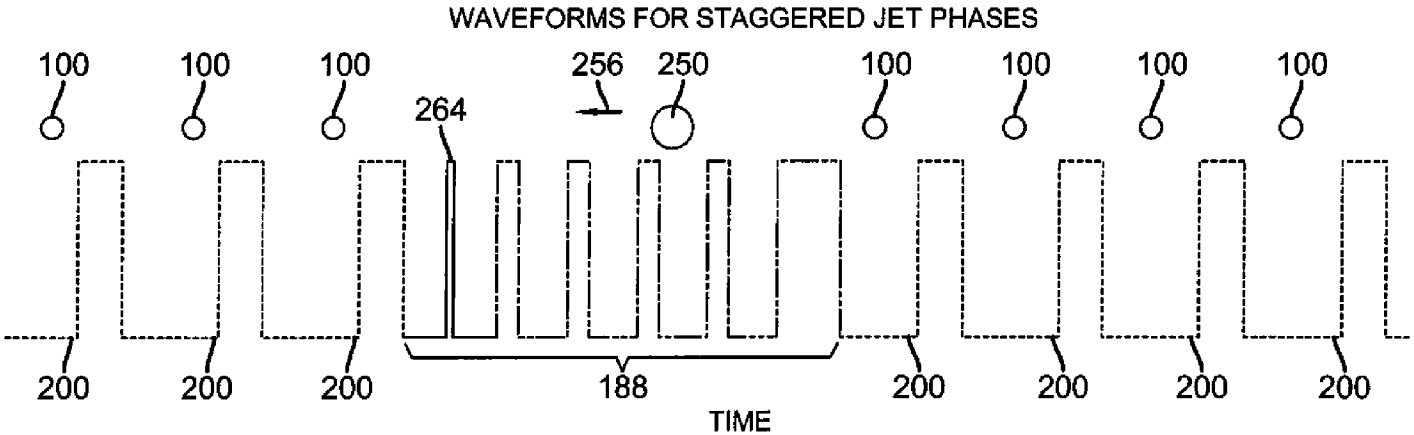
Figure 12H:
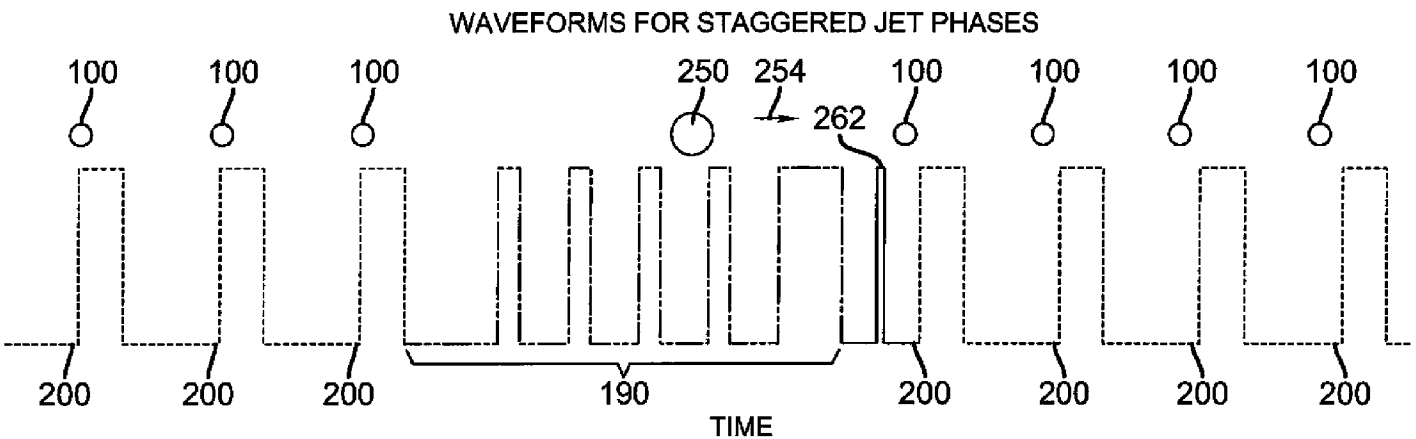

FIG. 12*c* shows a sequence of waveforms according to the invention where a velocity modifying pulse 258 is included to increase the velocity of the print drop 252 from the lagging jets as indicated by arrow 256, but no velocity modifying pulses are employed to modify the velocity of the print drop 250 for the leading jets in FIG. 12*d*. FIG. 12*e* shows a sequence of waveforms according to the invention where no velocity modifying pulses are employed to modify the velocity of the print drop 252 from the lagging jets, but a velocity modifying pulse 260 is inserted after the pulses of waveform 190, which created the print drop, to reduce the velocity of the print drop 250 from the leading jets in FIG. 12*f*. FIGS. 12*g* and *h* show waveforms where a velocity modify pulse 262 is used to reduce the velocity of the print drop 250 from the leading jets and a velocity modifying pulse 264 is used to increase the velocity of the print drop 252 of the lagging jets. The use of velocity modifying pulses to modify the velocity of print drops from both the even and the odd jets, allows a larger drop placement adjustment to be made or allows lower energy velocity modifying pulses to be used than are required if the velocity modifying pulses are applied to only one of the even or the odd numbered jets.

The embodiments of FIG. 12 *c-h* illustrate that the velocity modifying pulses can be applied differently for the odd and even number jets when there is a phase shift in the drop creation time for odd and even numbered jets for the printing of single pixel wide lines. In a similar manner, velocity modifying pulses can be applied differently for the odd and even number jets on the leading and trailing edges of strokes and even at synch incidents. For example, velocity modifying pulse may be inserted just prior to the waveforms form for creating print drops from only the even numbered jets at the leading edge of a stroke and may be inserted immediately after the waveforms for creating print drops from only the odd numbered jets at the trailing edge of a stroke.

Figure 13:
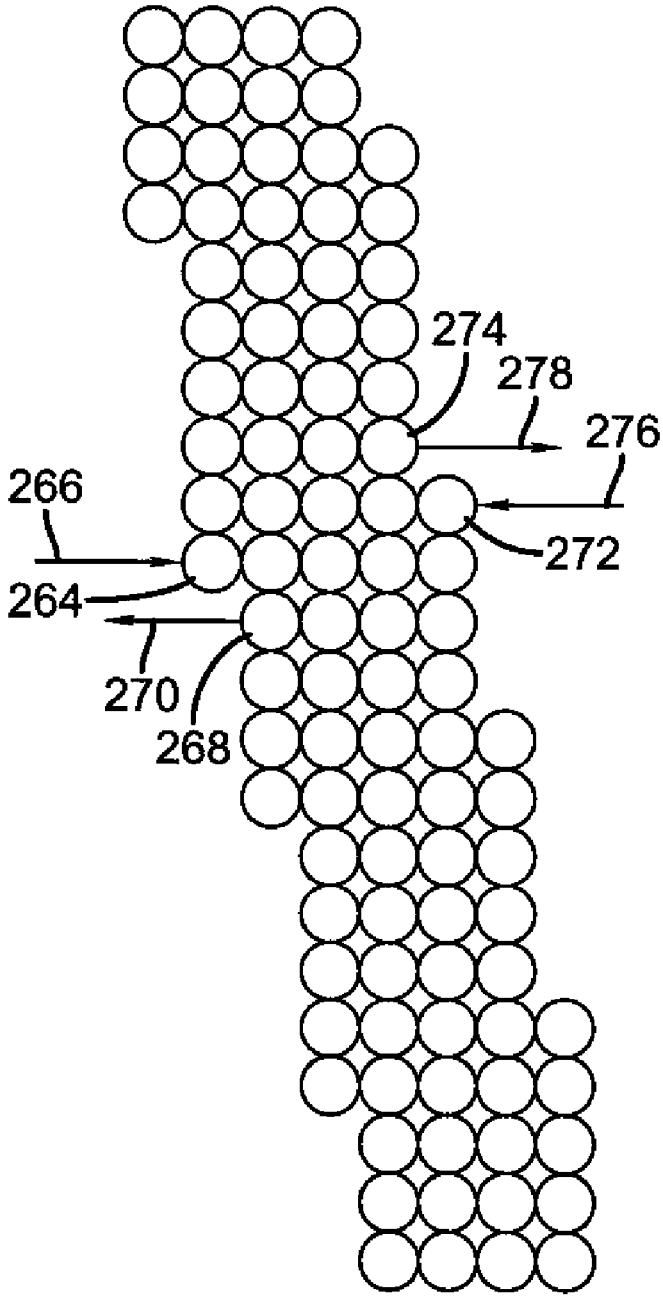
FIG. 13 show shows a portion of a sloping line that may be enhanced according to an embodiment of the invention

When printing sloping lines or strokes of characters, it is necessary to stair step the edges of the lines or strokes as shown in FIG. 13. In some instances, the steps can be detected by an observer, resulting in a reduction in perceived print quality. In an embodiment of the invention pre-pulses and/or post pulses can be employed to reduce the visibility of such steps. Inserting a velocity modifying pulse after the pulse or pulses of the waveform that created drop 264, a post-pulse, can reduce the velocity of drop 264 causing the print location of drop 264 to be shifted to the right as indicated by arrow 266. Inserting a velocity modifying pulse before the pulse or pulses of the waveform that created drop 268, a pre-pulse, can increase the velocity of drop 268 causing the print location of drop 268 to be shifted to the left as indicated by arrow 270. By means of either or both of a velocity modifying pre-pulse and a velocity modifying post-pulse as described above, the step can be rounded to reduce its visibility. In a similar manner, velocity modifying pre-pulses and post pulses can be employed for drops 272 and 274 to alter their velocities to cause their impact positions to be slightly shifted as indicated by arrows 276 and 278 respectively, to reduce the visibility of the step on the trailing edge of the line or stroke.

The amount by which the impact location of a print drop is shifted by a velocity modifying pulse is proportional to velocity shift of the print drop produced by the pulse. The velocity shift produced the velocity modifying pulses is related to the energy of the pulse. Increasing the pulse energy, by either increasing the pulse amplitude or pulse width, increases the amount of velocity shift produced. Adjustment of the pulse energy therefore serves as a means to adjust the impact position shift produced by velocity modifying pulses. The impact point shift produced by the velocity modifying pulses also depends on the spacing between the nozzle plate and the print media. As a result the preferred pulse energy for optimizing some aspect of the print can depend of the spacing between the nozzle plate and the print media. In some embodiments, the printing system can include a test pattern or other test to determine the optimum pulse energies for the velocity modifying pulses.

In yet another embodiment the width of character stroke can be modulated by means of velocity modifying pulses to pull forward or push back the drops at make the edges or the trailing edges of the strokes. Then can be used to enhance the readability of bar codes for example by refining the width ratios of wide and narrow strokes.

For some of these embodiments the velocity modifying pulses would be applied based on characteristics of the print data including, but not limited to, speeding up the first print drop in a series of print drops, smoothing out a step and refining the width of character strokes. In other embodiments, the need for a velocity modifying pulse is based on characteristics present at the printing, such as the odd-even or the synch band correction. Still further, in some embodiments, determining the need for a velocity modifying pulse includes determining the need based on at least the sequence of the following drops. For example, the following drop may include that the following drop is a catch drop. Alternatively, determining the need for a velocity modifying pulse includes determining the need based on the sequence of drops from an adjacent jet.

The present description will be directed in particular to elements forming part of, or cooperating more directly with, apparatus in accordance with the present invention. It is to be understood that elements not specifically shown or described may take various forms well known to those skilled in the art.

The invention claimed is:

1. Method for operating a continuous inkjet printer, the method comprising:

forming drops with a drop formation period being the time between consecutive drop formations;

creating a portion of the drops that strike the print media for forming print drops;

creating a portion of the created drops that do not strike the print media for forming catch drops;

creating the print drops to print on a series of consecutive pixel locations; wherein a time between the creation of consecutive print drops is inconsistent which causes an additional catch drop so that a gap is created;

wherein when a gap is created, adjusting a velocity of the print drop adjacent to the gap to cause the print drop to shift slightly toward the gap.

2. The method of claim 1, wherein the adjusting the velocity of a print drop adjacent to a gap to cause print drop to shift slightly toward the gap comprises an adjustment such that the velocity of the print drop preceding the gap is decreased.

3. The method of claim 1, wherein the adjusting the velocity of a print drop adjacent to a gap to cause print drop to shift slightly toward the gap comprises an adjustment such that the velocity of the print drop trailing the gap is increased.

4. The method of claim 1, wherein adjusting the velocity of the print drop comprises adjusting the energy of the drop formation pulse that creates the print drop.

5. The method of claim 1, wherein adjusting the velocity of the print drop comprises inserting a drop velocity modifying pulse adjacent to the drop modifying pulse that creates the print drop.

6. The method of claim 5, wherein the drop velocity modifying pulse is insufficient to initiate the formation of an additional print drop or catch drop.

7. The method of claim 5, wherein the drop velocity modifying pulse trails a print drop formation pulse to reduce the drop velocity of the print drop that precedes the gap.

8. The method of claim 5, wherein the drop velocity modifying pulse precedes a print drop formation pulse to increase the velocity of the print drop that trails the gap.

* * * * *